US005626318A

United States Patent [19]

Boettger et al.

[11] Patent Number: 5,626,318

[45] Date of Patent: May 6, 1997

[54] UNIVERSAL MOUNT URINAL HOLDER

[75] Inventors: Conrad H. Boettger; Bill J. Hawks, Jr., both of Wichita, Kans.

[73] Assignee: Via Christi Research, Inc., Wichita, Kans.

[21] Appl. No.: 378,637

[22] Filed: Jan. 26, 1995

[51] Int. Cl.[6] ..... A44B 21/00

[52] U.S. Cl. ..... 248/205.2; 248/218.4; 248/311.2

[58] Field of Search ..... 248/205.2, 205.1, 248/153, 146, 311.2, 302, 214, 219.4, 218.4

[56] References Cited

U.S. PATENT DOCUMENTS

| | | | |
|---|---|---|---|
| 1,086,541 | 2/1914 | Lailer | 248/311.2 |
| 1,219,025 | 3/1917 | Mertz | 248/220.1 |
| 2,044,520 | 6/1936 | Weiant, Jr. | 248/220.1 |
| 3,021,106 | 2/1962 | Kramer | 248/311.2 |
| 3,300,173 | 1/1967 | Kennedy, Jr. | 248/467 |
| 3,532,318 | 10/1970 | Lloyd | 248/311.2 |
| 4,324,381 | 4/1982 | Morris | 248/311.2 |
| 4,573,653 | 3/1986 | Boettger | 248/153 |
| 4,721,276 | 1/1988 | Moss | 248/205.2 |
| 4,896,858 | 1/1990 | Sokolski et al. | 248/311.2 |
| 5,249,770 | 10/1993 | Louthan | 248/311.2 |

*Primary Examiner*—Derek J. Berger
*Assistant Examiner*—Anita M. King
*Attorney, Agent, or Firm*—Hovey, Williams, Timmons & Collins

[57] ABSTRACT

A receptacle holder assembly (10, 76) for urinals (70, 78) is provided which allows mounting of the assemblies on a variety of differently configured support surfaces. The assembly (10, 76) includes a holder unit (12, 80) for supporting a removable urinal (70, 78) having a pair of spaced apart mounting legs (44, 46, 90, 92). An attachment member (14) is operatively coupled to each leg (44, 46, 90, 92) for independent pivoting movement thereof about the associated leg (44, 46, 90, 92). Each holder (14) is provided with either mating hook and loop strips (64, 68) or adhesive system (114), allowing the assembly to be secured to a variety of support surfaces (16, 74, 98).

10 Claims, 2 Drawing Sheets

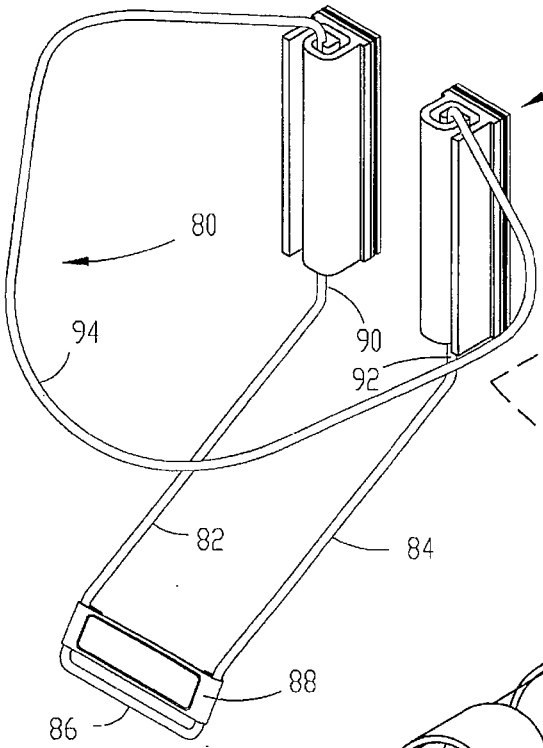
Fig. 4.
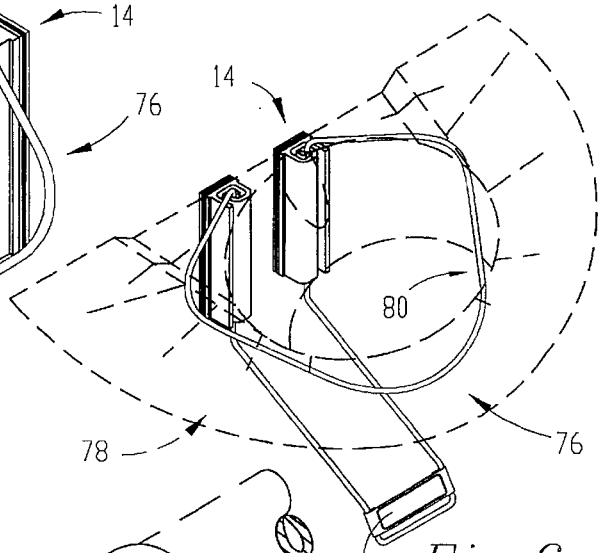
Fig. 6.
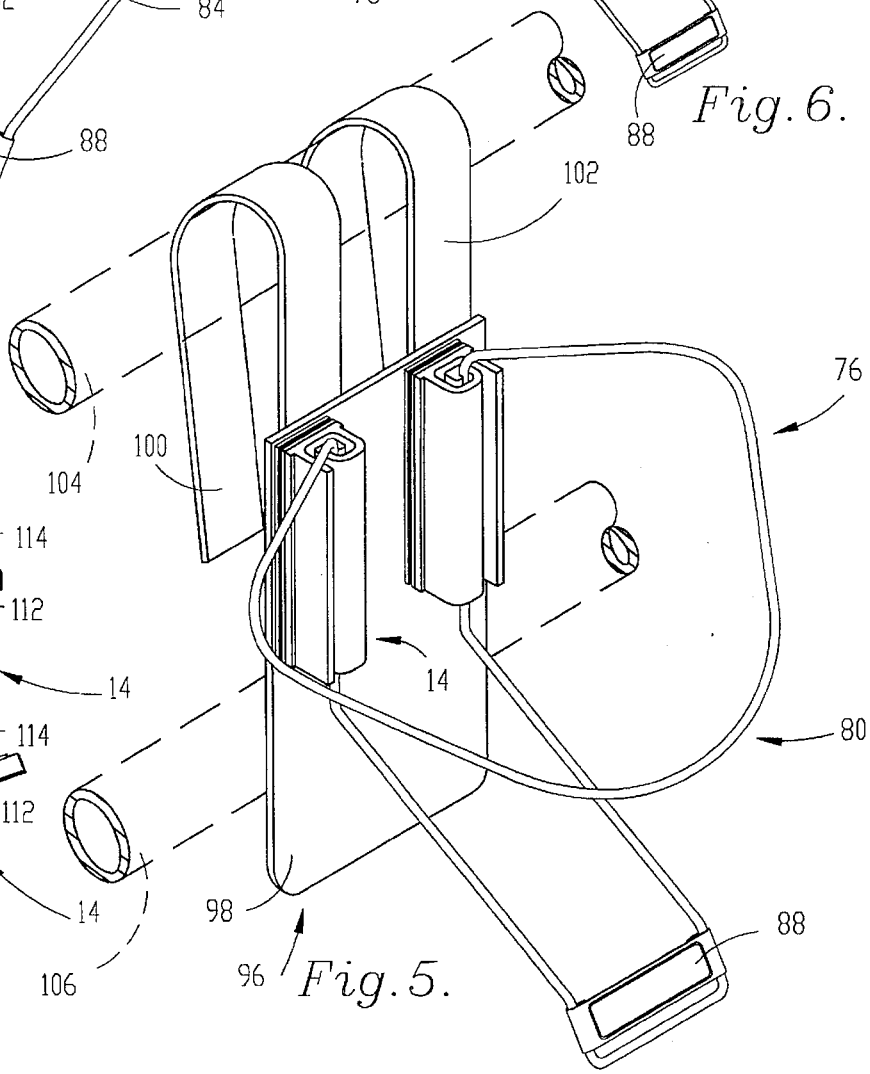
Fig. 5.
Fig. 7.
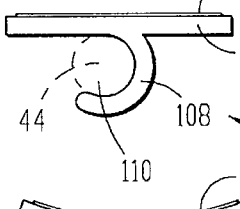
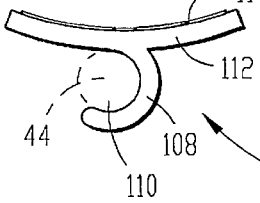
Fig. 8.

UNIVERSAL MOUNT URINAL HOLDER

BACKGROUND OF THE INVENTION

1. Field of the Invention

The present invention is broadly concerned with an improved receptacle holder assembly especially designed for the universal mounting and secure holding of urinals in a hospital or homecare setting. More particularly, the invention pertains to such a holder assembly including a holder unit, preferably wire-formed and presenting a pair of spaced apart mounting legs; an attachment member is coupled to each of the mounting legs to facilitate mounting of the assembly on a support surface such as a tubular body or flat wall.

2. Description of the Prior Art

In most hospitals and other patient care settings individual urinals are provided for bed-ridden patients. However, there is normally no particular area for location of urinal itself when not in use. Obviously, the urinal needs to be close to the patient for immediate use, and at the same time it cannot interfere with normal patient care services.

It is known to place urinals on an overbed stand or bedside cabinet. However, these expedients are often less than satisfactory owing to lack of easy accessibility to the urinal. Moreover, after use, care must be taken to avoid accidentally jarring or tilting the urinal and consequent spillage of its contents. Therefore, proper storage of a urinal must taken into account both easy accessibility and the need to avoid spillage after use.

U.S. Pat. No. 4,573,653 describes a wire-formed urinal holder designed to be secured to the upright standard of a hospital overbed table. While holders of this type are a decided improvement over the improvisations which have characterized the prior art, they are deficient in that no means is provided for mounting on a variety of possible support surfaces; thus, the holders of the '653 patent do not have universal applicability.

SUMMARY OF THE INVENTION

The present invention overcomes the problems outlined above and provides a universal mount receptacle holder assembly which can be securely mounted to a variety of support surfaces such as the exterior of tubular bodies or flat walls.

Broadly speaking, the holder assembly of the invention includes a receptacle holder unit including structure for supporting a removable receptacle such as an otherwise conventional urinal, and a pair of spaced apart mounting legs. An attachment member is operatively coupled to each leg for mounting of the holder unit on a support surface. Each attachment member includes structure permitting pivoting movement thereof about the associated holder unit leg for engaging the mounting surfaces of varying configuration.

In preferred forms, the receptacle-supporting structure is of rigid, wire-formed construction and includes a base and a holder-restraining element spaced above the base. Each of the attachment members advantageously is in the form of an elongated body having an axially extending opening therethrough which receives an associated mounting leg. One surface of each attachment member is provided with an adhesive coating or a hook and loop strip, hereinafter referred to by the trademark VELCRO strip, thereby allowing the attachment legs to be securely mounted to a support surface. In order to facilitate changeover of the attachment members, each of the latter preferably includes a generally spiral-like passageway in communication with the axial body opening permitting detachment of the members from the associated legs.

BRIEF DESCRIPTION OF THE DRAWINGS

FIG. 4 is a perspective view of another holder assembly in accordance with the invention, designed for supporting a hat-type urinal;

FIG. 5 is a perspective view illustrating the holder of FIG. 4 mounted upon a movable flat support, the latter being supported on a hospital bed rail;

FIG. 6 is a view similar to that of FIG. 4 but depicting in phantom a hat-type urinal supported by the assembly;

FIG. 7 is a plan view of an attachment member, illustrating one of the embodiments in accordance with the invention; and FIG. 8 is a plan view of an attachment member similar to that shown in FIG. 7, but slightly modified.

DETAILED DESCRIPTION OF THE PREFERRED EMBODIMENTS

Figure 1:
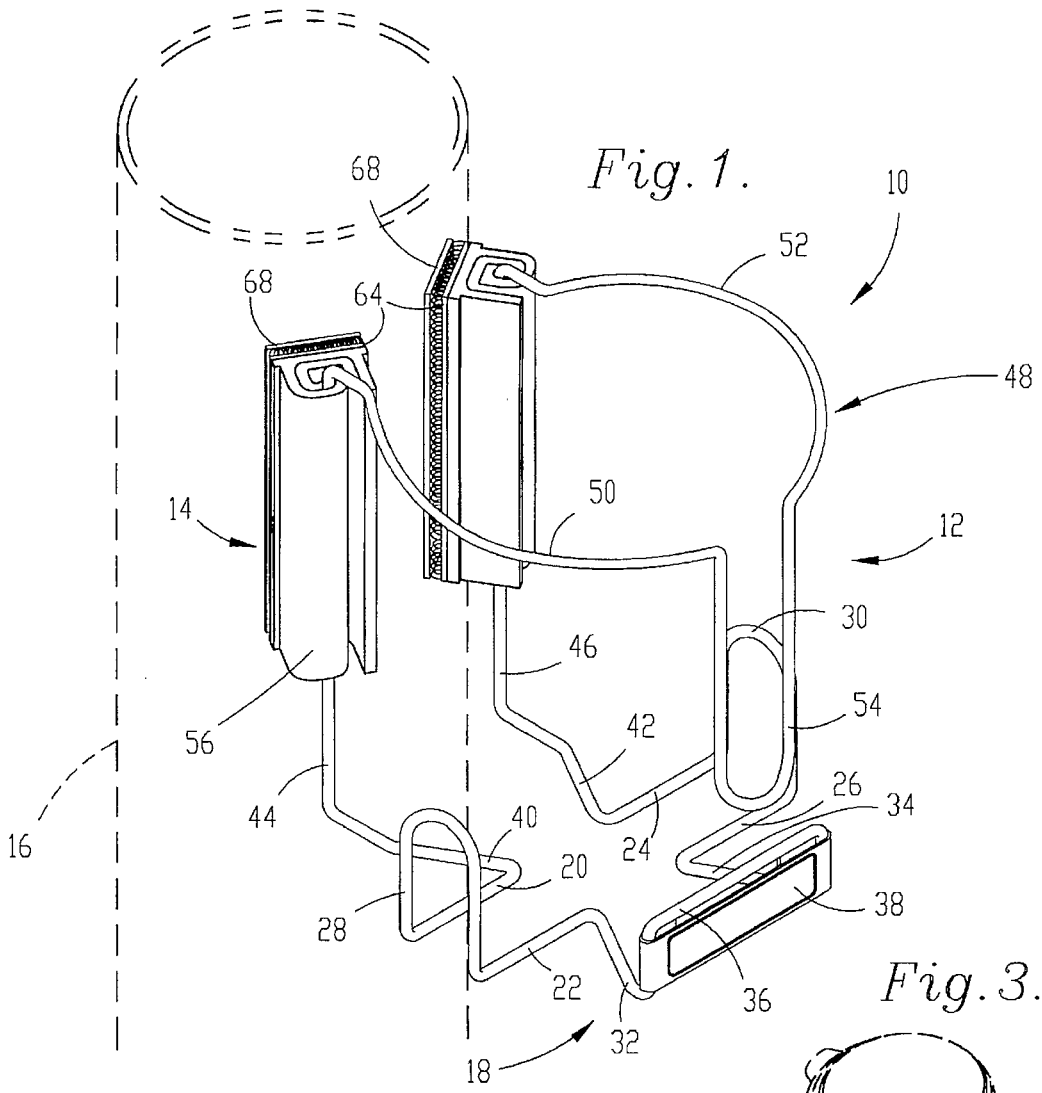
FIG. 1 is a perspective view of a receptacle holder assembly of the invention shown mounted to the exterior surface of a tubular body.

Turning now to the drawings, and particularly FIG. 1, a receptacle holder assembly 10 is depicted. The assembly 10 broadly includes a wire-formed holder unit 12 as well as a pair of attachment members 14. As illustrated, the assembly 10 is supported on the exterior surface of a tubular body 16.

In more detail, the holder unit 12 is preferably formed of substantially rigid wire and presents a base 18 including wire segments 20, 22, 24, 26 as well as upstanding, marginal, U-shaped keepers 28, 30; as seen, the keeper 28 forms an extension of parallel legs 20 and 22, whereas keeper 30 likewise forms an extension of legs 24 and 26. Legs 22 and 26 have obliquely oriented, forwardly extending sections 32, 34, the latter being interconnected by U-shaped segment 36. The latter carries an identification plate 38 allowing patient name or other relevant information to be affixed thereto.

The rearward legs 20 and 24 likewise include rearwardly, obliquely and upwardly extending segments 40, 42. Attachment legs 44, 46 extend upwardly from the corresponding segments 40 and 42. As illustrated, the legs 44, 46 are elongated, laterally spaced apart and substantially parallel with each other.

An arcuate restraining element 48 forms an extension from the top of legs 44, 46. The element 48 includes a pair of curved members 50, 52 respectively extending forwardly from the legs 44 and 46, as well as a forwardmost, depending, U-shaped retainer segment 54 spaced from and substantially centered between the legs 44, 46.

Each of the attachment members 14 is identical and includes a substantially rigid synthetic resin body 56 presenting a central, axially extending opening 58 therethrough which loosely receives the associated leg 44 or 46. This permits the attachment members 14 to independently pivot or rotate about the associated attachment leg. In addition, each of the bodies 56 presents an axially extending, generally spiral-like convoluted passageway 60 which communicates with the central opening 58 and leads to an outlet 62 (see FIG. 2). Thus, the attachment members 14 can be detached from the legs 44, 46 as desired.

Each of the attachment members 14 presents a rearmost flat surface 64. In preferred forms, a strip of VELCRO 66 is secured to the surface 64, and is adapted to mate with a complemental VELCRO strip 68, the latter being adhesively attached to a desired support surface.

Referring again to FIG. 1, it will be observed that, owing to the loose pivotal connection between the attachment members 14 and the mounting legs 44, 46, the respective attachment members can be pivoted so as to firmly engage a variety of support surfaces. In the context of FIG. 1, the tubular body 16 provides the support surface. In this regard, the assembly 10 is mounted to the exterior surface of the body 16 by adhesively securing complemental VELCRO strips 68 thereto, with the bodies 14 being pivoted as necessary to allow the VELCRO strip 64 to mate with the strips 68. When so used, a conventional urinal 70 (see FIG. 3) can be readily placed within the unit 12, with the urinal handle 72 being accommodated by forward retainer segment 54. The bottom of the urinal 70 rests upon base 18, whereas the upper restraining element 48 retains the urinal 70 in place within the assembly. As will be readily appreciated, the urinal 70 can be easily removed for use and can thereafter be placed back within the assembly 10.

Figure 2:
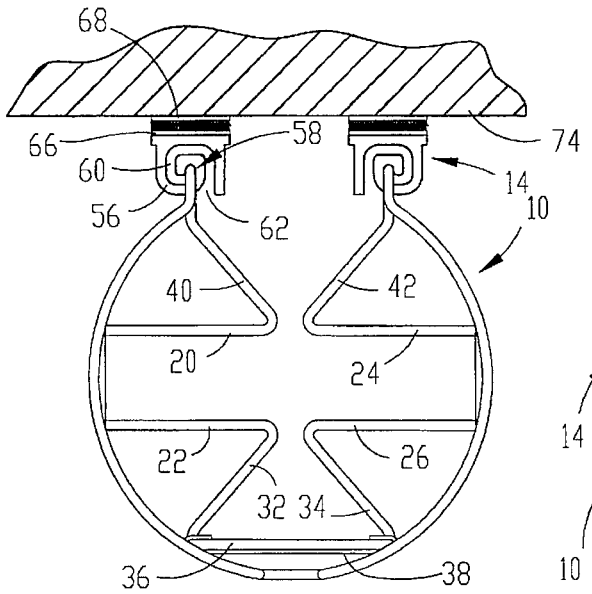
FIG. 2 is a plan view of the holder illustrated in FIG. 1, depicting the holder secured to a flat wall surface.

As illustrated in FIG. 2, the assembly 10 can also be attached to a flat wall surface 74. This is accomplished in exactly the same manner as described with reference to attachment to the tubular body 16.

FIGS. 4–6 illustrate another holder assembly 76 in accordance with the invention. The assembly 76 is specifically designed for supporting a hat-type urinal 78 used with conventional toilets. The assembly 76 includes a wire-formed receptacle holder unit 80 as well as attachment members 14. The unit 80 is also formed of wire presenting a pair of forwardly extending base segments 82, 84 interconnected by a U-shaped segment 86; an identification panel 88 is secured to the segment 86 as shown. Attachment legs 90, 92 extend upwardly from the rearward ends of the segments 82, 84, and a forwardly extending, arcuate retainer 94 interconnects the upper ends of the legs 90, 92. As illustrated, the elongated attachment members 14 are loosely and pivotally mounted on the upright attachment legs 90, 92.

Figure 3:
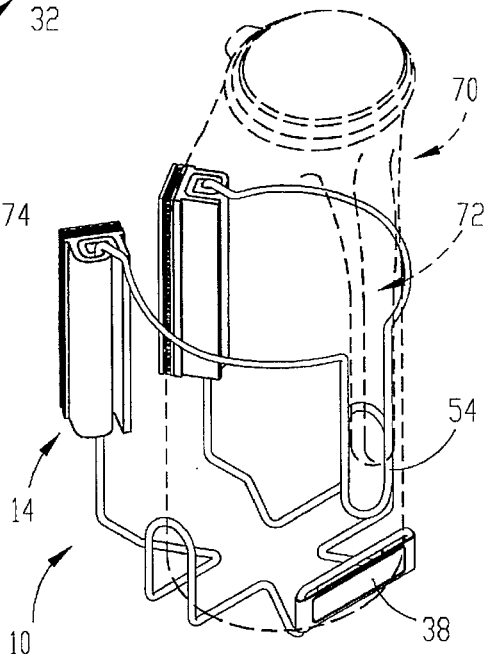
FIG. 3 is a view similar to that of FIG. 1, but illustrates in phantom a urinal supported within the assembly.

Referring specifically to FIG. 6, it will be seen that the urinal 78 is readily accommodated and supported by the assembly 76, and attachment of the latter to a variety of wall surfaces is accomplished exactly as described with reference to the embodiments of FIGS. 1–3.

FIG. 5 illustrates a further modification wherein the assembly 76 is affixed to a movable support 96. The latter includes a flat synthetic resin plate 98 with a pair of upwardly extending, U-shaped attachment straps 100, 102 secured to the rear face of plate 98. The straps 100, 102 are configured to receive a hospital bed rail 104 as depicted, with the overall length of the support 96 assuring that the rear face of plate 98 engages the next lower bed rail 106. Thus the support 96 provides, in conjunction with the bed rails 104, 106, a secure mounting surface for the assembly 76 (or for that matter assembly 10 if desired). It will further be readily appreciated that securement of assembly 76 to plate 98 is accomplished in the manner described previously with reference to assembly 10, i.e., the respective attachment members 14 are secured via VELCRO or other desired attachment means to plate 98, thereby providing a convenient support for urinal 78.

FIGS. 7 and 8 illustrate a modification of the attachment members 14 wherein the aforementioned spiral-like passageway 60 is replaced with a C-shaped hook element 108. The element 108 presents an opening 110 which is adapted to loosely receive an associated leg 44 or 46 (shown in phantom). Accordingly, this form of the attachment member is also permitted to independently pivot or rotate about the associated attachment leg. Although not shown, it will be appreciated that the element 108 and opening 110 extend along the entire length of the member 14.

As shown in FIG. 7, the attachment member 14 presents a flat rearmost surface 112, which is adapted for attachment to a wall or the like. Alternatively, the rearmost surface may be arcuate (see FIG. 8) to facilitate attachment to a cylindrical surface. As depicted in FIGS. 7 and 8, the rearmost surface 112 is provided with a strip of double-coated adhesive 114 for direct and permanent attachment to the support surface.

What is claimed is:

1. A receptacle holder assembly, comprising:

a receptacle holder unit including structure for supporting a removable receptacle, and a pair of elongated, generally parallel and spaced apart mounting legs; and an attachment member operatively coupled to each leg for mounting the unit on a support surface, each attachment member including structure permitting pivoting movement thereof about one of said holder unit legs for engaging mounting surfaces of varying configuration, each of said attachment members comprising an elongated body having an axially extending opening therethrough receiving one of said holder unit legs, each of said bodies having an axially extending, generally spiral-like passageway in communication with said opening therethrough for permitting detachment of the attachment members from said legs.

2. The assembly of claim 1, said structure for supporting a removable receptacle comprising a base and a receptacle-restraining element spaced from said base.

3. The assembly of claim 1, said structure for supporting a removable receptacle being formed of a rigid wire or a semi-rigid polymer.

4. The assembly of claim 1, each of said attachment members having a surface bearing an adhesive system for securement of the attachment member to said support surface.

5. The assembly of claim 1, said opening being defined by an axially extending C-shaped hook element for permitting detachment of the attachment members from said legs.

6. The assembly of claim 1, each of said attachment members being mounted for independent pivoting movement thereof about an associated holder unit leg.

7. A receptacle holder assembly, comprising:

a receptacle holder unit including structure for supporting a removable receptacle and presenting an upper margin and an opposed lower margin, and a pair of elongated, generally parallel and spaced apart mounting legs each secured to said upper and lower margins; and an elongated attachment member operatively coupled to each of said legs for independent pivoting movement thereof about the leg, each attachment member having an upper margin, an opposed lower margin, an attachment surface extending between said upper and lower margins, and wall means remote from said attachment surface defining an elongated, axially extending opening for receiving one of said mounting legs and permitting pivoting movement of the attachment member about said one leg, each attachment member further including structure defining an elongated, axially extending, leg entrance and exit passageway coextensive in length with said leg-receiving opening and communicating with the latter, said passageway extending laterally from said leg-receiving opening for alternate placement of one of said legs within the opening and removal of the leg therefrom by relative lateral movement between the leg and member.

8. The assembly of claim 7, said receptacle holder unit being formed of a rigid wire or semi-rigid polymer.

9. A receptacle holder assembly for removably holding a receptacle presenting a base and an upstanding sidewall, said assembly comprising:

an integral, wire-formed receptacle holder unit including a pair of upright, laterally spaced apart legs each having an upper end and a lower end, an integral, arcuate, receptacle-restraining member extending forwardly from the upper ends of said legs, and an integral base element extending forwardly from the lower ends of said legs, said base element being configured for supporting the base of said receptacle, and said receptacle-restraining member being configured for engaging the upstanding sidewall of said receptacle; and an elongated attachment member operatively coupled to each of said legs for independent pivoting movement thereof about the leg, each attachment member having an upper margin, an opposed lower margin, an attachment surface extending between said upper and lower margins, and wall means remote from said attachment surface defining an elongated, axially extending opening for receiving one of said mounting legs and permitting pivoting movement of the attachment member about said one leg, each attachment member further including structure defining an elongated, axially extending leg entrance and exit passageways coextensive in length with said leg-receiving opening and communicating with the latter, said passageway extending laterally from said leg-receiving opening for alternate placement of one of said legs within the opening and removal of the leg therefrom by relative lateral movement between the leg and member.

10. The assembly of claim 9, said receptacle holder unit being formed of a rigid wire or semi-rigid polymer.

* * * * *